US007041889B1

(12) United States Patent
Hsieh

(10) Patent No.: US 7,041,889 B1
(45) Date of Patent: May 9, 2006

(54) GUITAR-LIKE MUSICAL INSTRUMENT WITH A NECK-BODY CONNECTING ASSEMBLY

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 11/034,955

(22) Filed: Jan. 14, 2005

(51) Int. Cl.
*G10D 3/00* (2006.01)

(52) U.S. Cl. ..... 84/291; 84/293; 84/267

(58) Field of Classification Search ..... 84/290, 84/291, 293, 267, 292
See application file for complete search history.

(56) References Cited

U.S. PATENT DOCUMENTS 4,982,640 A * 1/1991 Buscarino ..... 84/293
6,051,766 A * 4/2000 Taylor ..... 84/293

* cited by examiner

*Primary Examiner*—Kimberly Lockett
(74) *Attorney, Agent, or Firm*—Troxell Law Office, PLLC

(57) ABSTRACT

A guitar-like musical instrument has a body and a neck and a neck-body connecting assembly. The body has a sidewall. The neck has a distal end and a proximal end. The neck-body connecting assembly has a neck mount, a mounting block, two alignment pins and two bolts. The neck mount is formed in the sidewall of the body. The mounting block is formed at the proximal end of the neck and is attached to the neck mount. The alignment pins are mounted in the neck mount and the mounting block. The bolts extend through the neck mount and screw into the mounting blocks. The bolts securely and tightly connect the neck and the body and cooperate with the alignment pins to prevent the neck from wobbling relative to the body.

1 Claim, 4 Drawing Sheets

GUITAR-LIKE MUSICAL INSTRUMENT WITH A NECK-BODY CONNECTING ASSEMBLY

BACKGROUND OF THE INVENTION

1. Field of the Invention

The present invention relates to a guitar-like musical instrument, and more particularly to a guitar-like instrument with a neck-body connecting assembly that securely connects a neck of the guitar-like musical instrument such as a classic guitar or an electric guitar to a body of the instrument.

2. Description of Related Art

Guitar-like musical instruments such as classic guitars, electric guitars and the like have a body and a neck. The body and neck of such musical instruments cannot be as a single piece and must be fabricated separately and connected together with a connecting assembly.

With reference to FIG. 3, a conventional guitar has a body (31), a neck (30) and a connecting assembly.

The body (31) is hollow and has a sidewall (311).

The neck (30) has a distal end and a proximal end.

The connecting assembly (30) is connected between proximal end of the neck (30) and the sidewall (311) of the body (31) and has a tapered mounting slot (33) and a mounting block (32). The tapered mounting slot (33) is defined in the sidewall (311) of the body (30). The mounting block (32) is attached to the proximal end of the neck (30) and has a tapered mounting protrusion (321). The tapered mounting protrusion (321) is formed on the mounting block (32) and corresponds to the tapered mounting slot (33). An adhesive is applied to the tapered mounting protrusion (321), and the tapered mounting protrusion (321) is mounted in the tapered mounting slot (33) so the body (31) and the neck (30) are bonded tightly together.

However, the adhesive deteriorates after a period of time, which results in the undesired detachment of the body (31) and the neck (30).

With reference to FIG. 4, another conventional guitar has a body (41), a neck (40) and a connecting assembly.

The body (41) is hollow and has a sidewall (411).

The neck (40) has a distal end and a proximal end.

The connecting assembly connects the body (41) and the neck (40) and has a neck mount (43), a mounting block (42) and two pins (44).

The neck mount (43) is mounted through the sidewall (411) of the body (41) and has an outside, two opposite sides, two side lips, a rectangular recess (431) and two pairs of mounting holes (432). The side lips extend from the outside and are adjacent respectively to opposite sides of the neck mount (43). The rectangular recess (431) is defined through the neck mount (43) between the side lips. The mounting holes (432) are defined transversely through the side lips and communicate with the rectangular recess (431). The mounting holes (432) in one side lip are aligned respectively with the mounting holes (432) of the other side lip.

The mounting block (42) is mounted on the proximal end of the neck (40) and has a rectangular mounting protrusion (421). The rectangular mounting protrusion (421) is formed on the mounting block (42), is mounted in the rectangular recess (431) in the neck mount (43) and has two mounting holes (422). The mounting holes (422) are defined transversely through the rectangular mounting protrusion (421) and are aligned with the mounting holes (432) in the neck mount (43).

The pins (44) are mounted in the mounting holes (432) in the neck mount (43) and the mounting holes (422) in the mounting block (42) to tightly connect the neck (40) to the body (41).

However, any looseness and imprecision in attaching the rectangular mounting protrusion (421) on the mounting block (42) to the rectangular recess (431) in the neck mount (43) results in the wobbling of the neck (40) relative to the body (41).

To overcome the shortcomings, the present invention provides a guitar-like musical instrument with a neck-body connecting assembly to mitigate or obviate the aforementioned problems.

SUMMARY OF THE INVENTION

The main objective of the invention is to provide a guitar-like musical instrument with a neck-body connecting assembly that will provide a firm and solid connection.

A guitar-like musical instrument in accordance with the present invention comprises a body, a neck and a neck-body connecting assembly.

The body has a sidewall.

The neck has a distal end and a proximal end.

The neck-body connecting assembly has a neck mount, a mounting block, two alignment pins and two bolts. The neck mount is formed in the sidewall of the body. The mounting block is formed at the proximal end of the neck and is attached to the neck mount. The alignment pins are mounted in the neck mount and the mounting block. The bolts extend through the neck mount and screw into the mounting blocks.

Other objectives, advantages and novel features of the invention will become more apparent from the following detailed description when taken in conjunction with the accompanying drawings.

DETAILED DESCRIPTION OF PREFERRED EMBODIMENT

Figure 1:
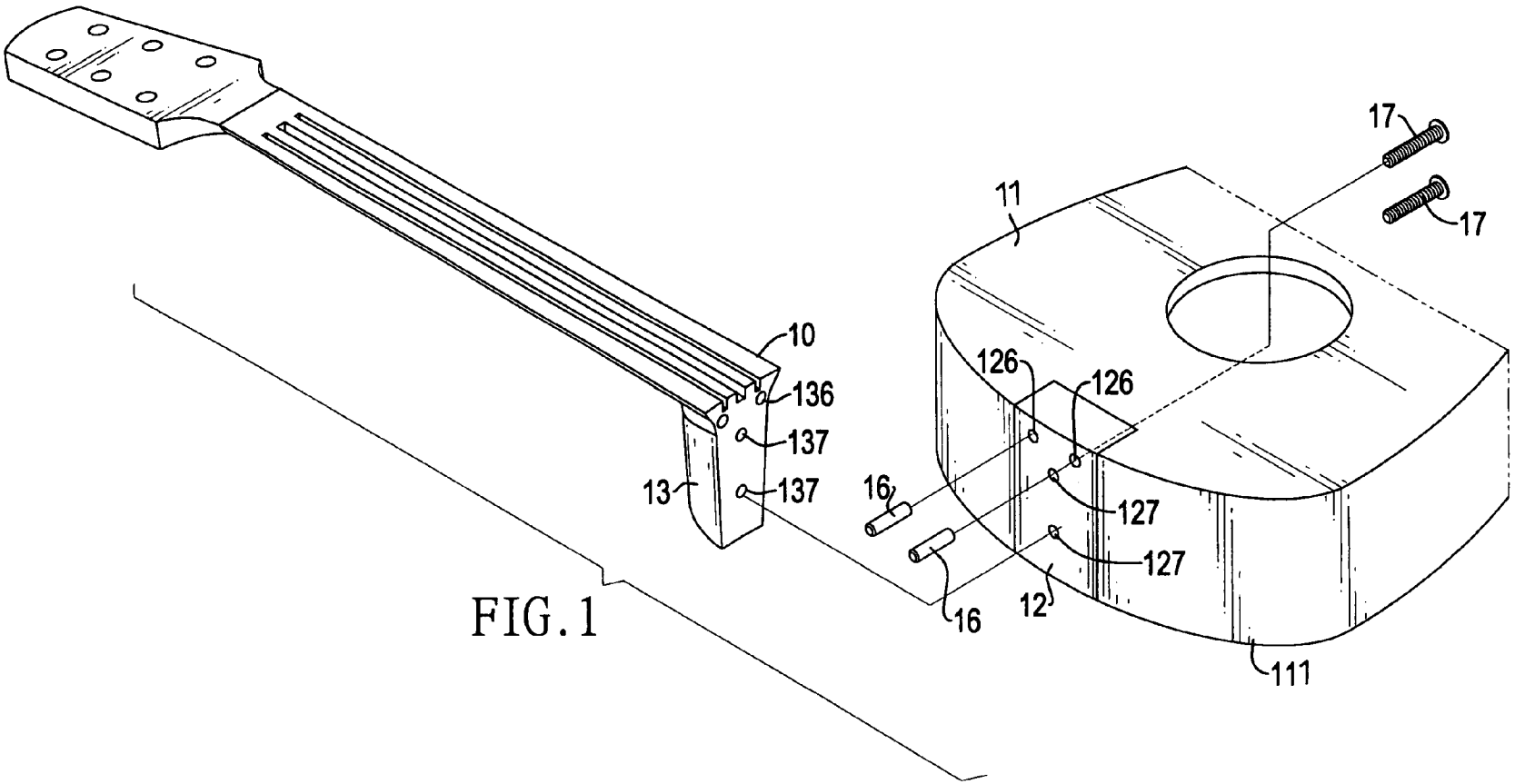
FIG. 1 is an exploded perspective view of a guitar-like musical instrument with a neck-body connecting assembly in accordance with the present invention.
Figure 2:
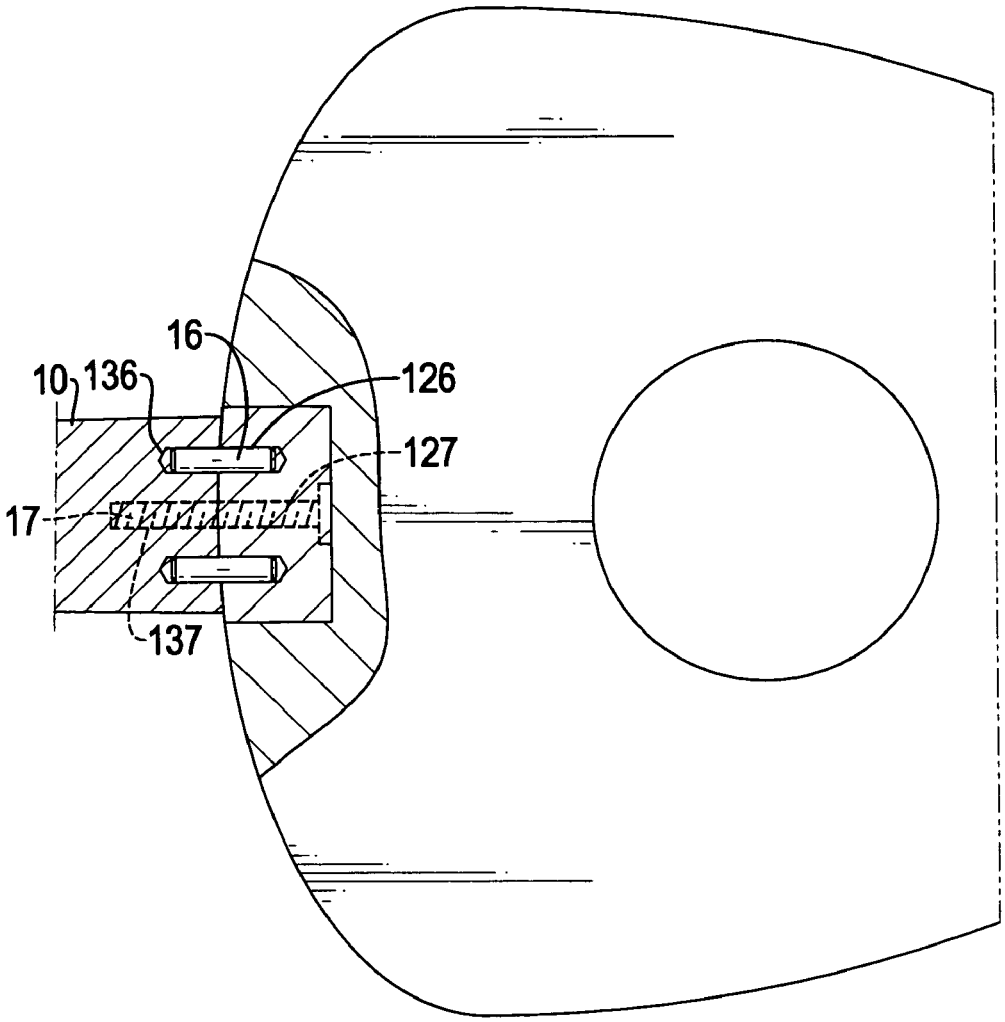
FIG. 2 is a top view in partial section of the guitar-like musical instrument in FIG. 1.
Figure 3:
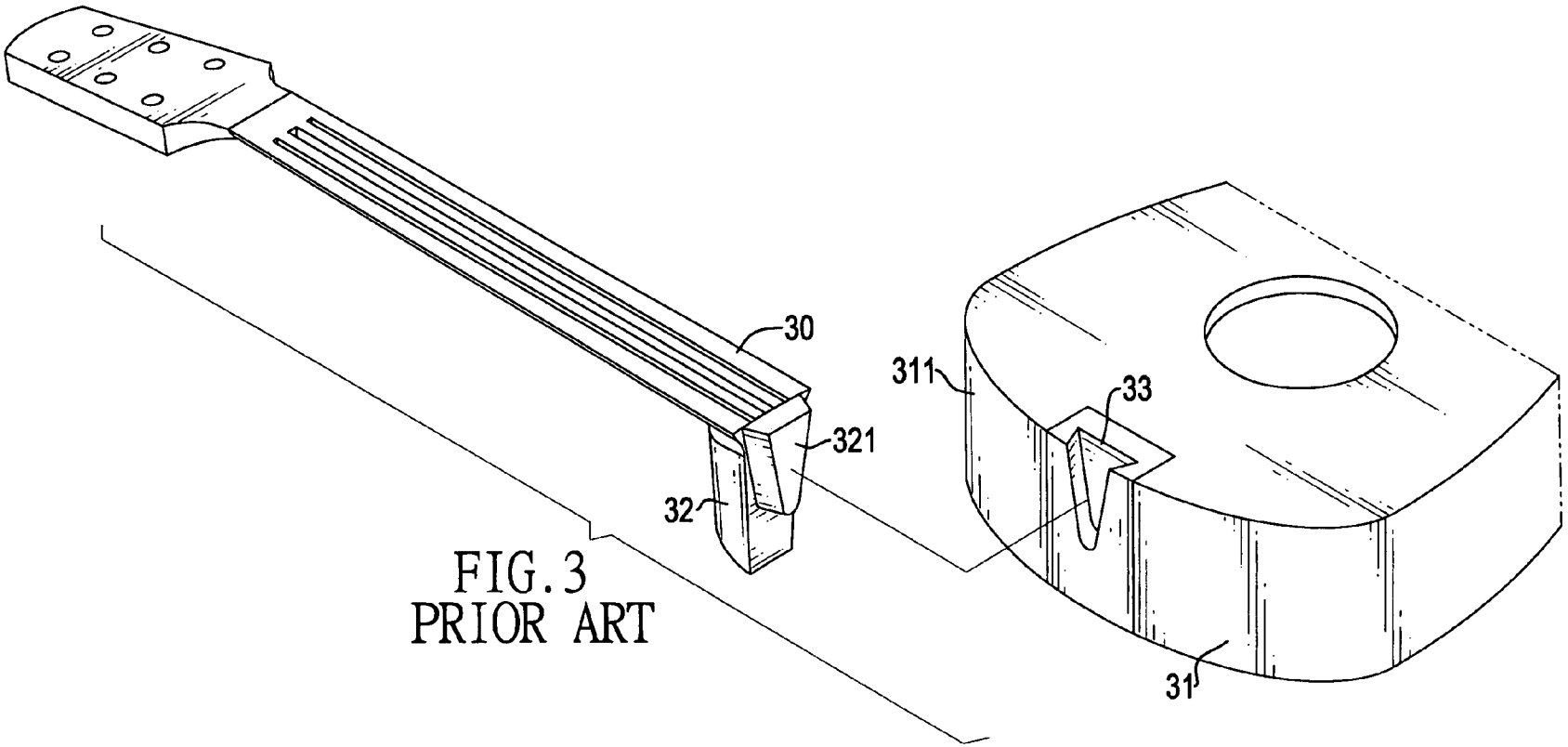
FIG. 3 PRIOR ART
FIG. 3 is an exploded perspective view of a conventional guitar in accordance with the prior art.
Figure 4:
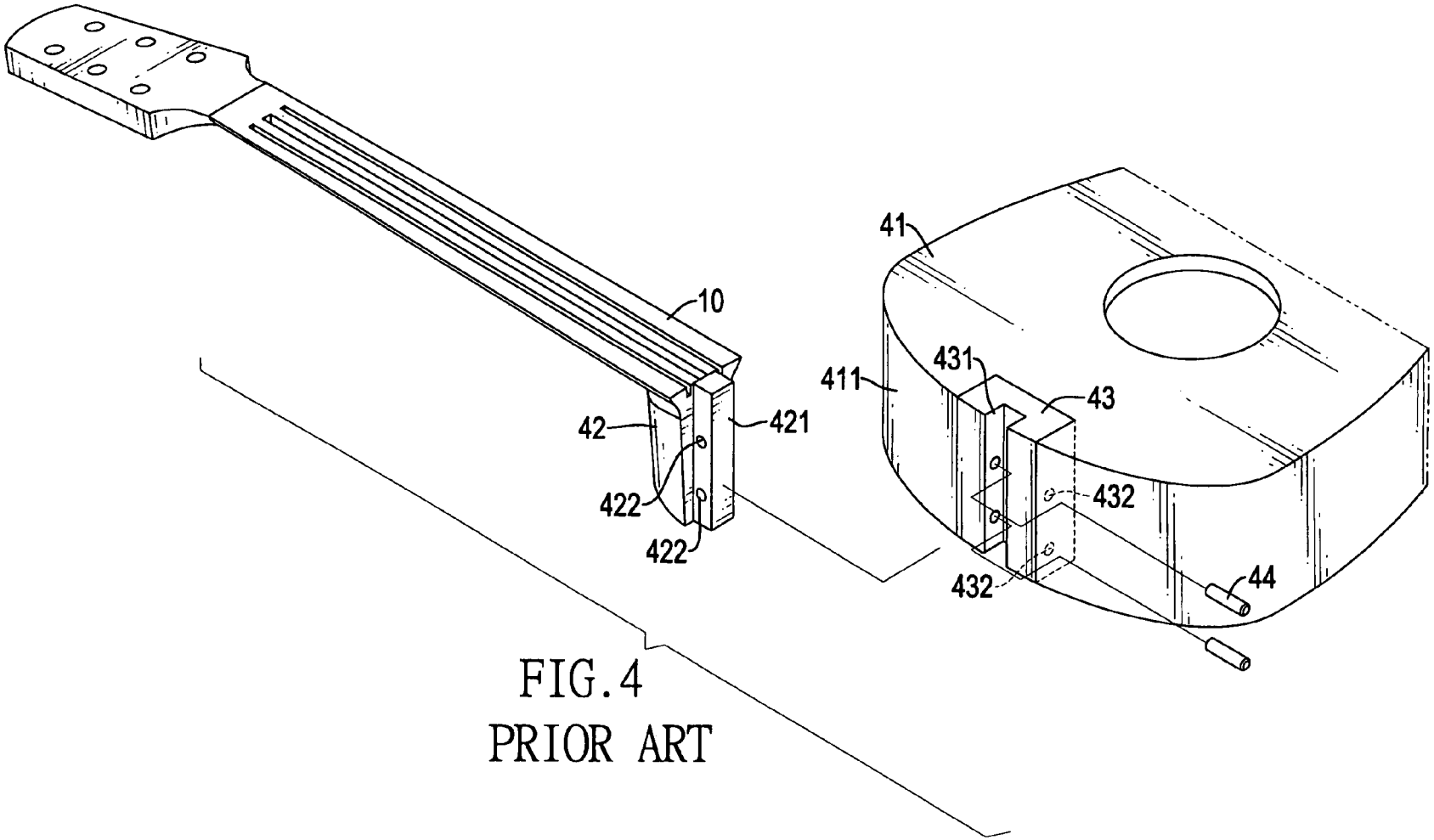
FIG. 4 PRIOR ART
FIG. 4 is an exploded perspective view of another conventional guitar in accordance with the prior art.

With reference to FIGS. 1 and 2, a guitar-like musical instrument in accordance with the present invention comprises a body (11), a neck (10) and a neck-body connecting assembly.

The body (11) is hollow and has a sidewall (111).

The neck (10) has a distal end and a proximal end.

The neck-body connecting assembly has a neck mount (12), a mounting block (13), two alignment pins (16) and two bolts (17).

The neck mount (12) is formed in the sidewall (111) and has an outside surface, two alignment holes (126) and two through holes (127). The alignment holes (126) are defined perpendicularly in the outside surface of the neck mount (12)and are arranged along a first line. The through holes (127) are defined longitudinally through the neck mount (12) and are arranged along a second line perpendicular to the first line.

The mounting block (13) is formed at the proximal end of the neck (10), is mounted on the outside surface of the neck mount (12), is mounted to the neck mount (12) and has a proximal surface, two alignment holes (136) and two threaded holes (137). The alignment holes (136) are defined perpendicularly in the proximal surface of the mounting block (13) and are aligned respectively with the alignment holes (126) in the neck mount (12). The threaded holes (137) are defined perpendicularly in the proximal surface of the mounting block (13) and are aligned respectively with the through holes (127) in the neck mount (12). Each threaded hole (137) in the mounting block (13) has an inner thread.

The pins (16) are mounted respectively in the aligned alignment holes (126, 136) in the neck mount (12) and the mounting block (13).

The bolts (17) extend respectively through the through holes (127) in the neck mount (12) and screw into the threaded holes (137) in the mounting block (13). Each bolt has an outer thread corresponding to the inner threads of the threaded holes (137) in the mounting block (13).

The bolts (17) securely and tightly connect the neck (10) and the body (11) to prevent the neck (10) from wobbling up and down relative to the body (11). The alignment pins (16) extend in the neck (10) and the body (11) to prevent the neck (10) from wobbling left and right relative to the body (11).

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A guitar-like musical instrument comprising having a hollow body having a sidewall;

a neck having a distal end and a proximal end; and a neck-body connecting assembly connected between the sidewall of the body and the proximal end of he neck and having a neck mount having an outside surface;

two alignment holes defined perpendicularly in the outside surface of the neck mount and arranged along a first line; and two through holes longitudinally through the neck mount and arranged along a second line perpendicular to the first line;

a mounting block mounted to the neck mount and having a proximal surface;

two alignment holes defined perpendicularly in the proximal surface of the mounting block and aligned respectively with the alignment holes in the neck mount; and two threaded holes defined perpendicularly in the proximal face of the mounting block and aligned respectively with the through holes in the neck mount;

two pins mounted respectively in the aligned alignment holes in the neck mount and the mounting block; and two bolts extending respectively through the through holes in the neck mount and screwing into the threaded holes in the mounting block, and each bolt having an outer thread corresponding to the inner threads of the threaded holes in the mounting block.

* * * * *